US008745913B2

(12) United States Patent
Hicks

(10) Patent No.: US 8,745,913 B2
(45) Date of Patent: Jun. 10, 2014

(54) VERSATILE SHOOTING REST

(75) Inventor: Kim Melvin Hicks, Fredericksburg, TX (US)

(73) Assignee: Battenfeld Technologies, Inc., Columbia, MO (US)

( * ) Notice: Subject to any disclaimer, the term of this patent is extended or adjusted under 35 U.S.C. 154(b) by 55 days.

(21) Appl. No.: 13/292,927

(22) Filed: Nov. 9, 2011

(65) Prior Publication Data

US 2012/0174460 A1 Jul. 12, 2012

Related U.S. Application Data

(60) Provisional application No. 61/414,996, filed on Nov. 18, 2010.

(51) Int. Cl.
*F41C 27/00* (2006.01)

(52) U.S. Cl.
USPC ..... 42/94; 73/167

(58) Field of Classification Search
USPC ..... 42/94; 73/167
See application file for complete search history.

(56) References Cited

U.S. PATENT DOCUMENTS 3,358,504 A * 12/1967 Freebairn ..... 73/167
3,445,082 A 5/1969 Proctor et al.
4,007,554 A * 2/1977 Helmstadter ..... 42/94
4,026,057 A * 5/1977 Cady ..... 42/94
4,345,398 A * 8/1982 Pickett ..... 42/94
4,409,751 A 10/1983 Goda et al.
5,070,636 A 12/1991 Mueller
5,081,783 A 1/1992 Jarvis
5,375,804 A * 12/1994 Levilly ..... 89/37.04
5,622,341 A 4/1997 Stana
6,446,848 B1 9/2002 Swisher
6,484,913 B1 11/2002 Hancock et al.
6,539,660 B1 * 4/2003 Yeargin ..... 42/94
D476,290 S 6/2003 Gates et al.
6,574,899 B1 * 6/2003 Mostello ..... 42/94
6,877,266 B1 4/2005 Brownlee
D519,183 S 4/2006 Minneman
7,066,365 B2 * 6/2006 Brown ..... 224/401
D540,904 S 4/2007 Werner
7,281,347 B2 10/2007 Carpenter
7,337,934 B2 3/2008 Alling et al.
7,356,960 B1 4/2008 Knitt
7,584,690 B2 9/2009 Cauley
7,587,854 B2 9/2009 Werner (Continued)

OTHER PUBLICATIONS

Disclosure Statement of Kim Melvin Hicks, signed Apr. 22, 2010.

(Continued)

*Primary Examiner* — Samir Abdosh

(57) ABSTRACT

A versatile shooting rest has a base with an adjustable riser on its nose. A clamp mechanism holds a riser in place so that a rest on the riser's end can be situated at desired heights. The base affixes to a tripod or other stand and preferably uses a ball stem that allows for rotation. The base supports the butt, handle, or rear portion of the weapon, while the rest on the riser's upper end supports the forearm, barrel, or front portion of the weapon. An insert can attach in this rest so the rest and insert can accommodate various types of weapons. The versatile shooting rest can be adjusted to accommodate a number of weapons used for hunting, including handguns, pistols, revolvers, long rifles, AR style rifles, and crossbows.

35 Claims, 9 Drawing Sheets

(56) References Cited

U.S. PATENT DOCUMENTS

| | | | | |
|---|---|---|---|---|
| D617,532 | S | 6/2010 | Zeller et al. | |
| D626,620 | S | 11/2010 | Hicks | |
| D627,033 | S | 11/2010 | Hicks | |
| 2003/0173388 | A1 | 9/2003 | Hancock et al. | |
| 2004/0113041 | A1 | 6/2004 | Hancock et al. | |
| 2005/0115137 | A1 | 6/2005 | Minneman | |
| 2007/0068379 | A1 | 3/2007 | Sween et al. | |
| 2008/0134555 | A1 * | 6/2008 | Werner | 42/69.01 |
| 2009/0205238 | A1 | 8/2009 | Willis, Jr. | |
| 2009/0249675 | A1 | 10/2009 | Cauley | |

OTHER PUBLICATIONS

BogGear Advertising Materials submitted in Trademark Application Ser. No. 77738468, Attachments #1-20, generated Jun. 30, 2009.
Other Advertising Materials submitted in Trademark Application Ser. No. 77738468, Attachments #21-33, generated Jun. 30, 2009.
"BOG-POD Advertisement," Blackpowder Guns & Hunting Magazine, Fall 2007.
"BOG-POD Advertisement," America's Freedom Magazine, Jul. 2007.
BOG-POD Advertisement, Gun Hunter Magazine, Aug. 2007.
"Western . . . ," Gun World Magazine, Oct. 2007.
"BOG-POD TRI-POD," Guns Magazine, Nov. 2007.
"BOG-POD," Guns Magazine, Aug. 2007.
"New Load for an Old Favorite," Guns & Ammo Magazine, Sep. 2007.
"The Right Stuff," Heartland USA Magazine, Sep./Oct. 2007.
"BOG-POD featured," North American Hunter Magazine, Nov. 2007.
"BOG-POD Advertisement," Outdoor Life Magazine, Apr. 2007.
"BOG-POD-3 Tripod," Rifle Magazine, Jul. 2007.
"Warm Layers for Cool Safaris," Sports Afield Magazine, Nov. 2007.
"BOG Gear BOG-PODS," Sports Afield Magazine, Jan. 2008.
"BOG Gear," Turkey Call Magazine, Sep./Oct. 2007.
"Pro-Hunter Series Accessories," Ultrec Engineered Produces, LLC., obtained from www.ultrec.com, generated Jan. 28, 2010.
"Pro-Hunter Sticks—Tripod," Ultrec Engineered Produces, LLC., obtained from www.ultrec.com, generated Jan. 28, 2010.
"Pro-Hunter Sticks—Monopod," Ultrec Engineered Produces, LLC., obtained from www.ultrec.com, generated Jan. 28, 2010.
"Pro-Hunter Sticks—Bipod," Ultrec Engineered Produces, LLC., obtained from www.ultrec.com, generated Jan. 28, 2010.
Cabela's, "BOGgear BOG-POD® Xtreme Shooting Rest," obtained from www.cabelas.com. generated Oct. 18, 2011.
Gander Mountain®, "Firearms > Firearm Accessories > Shooting Rest," obtained from http://search.gandermountain.com/?Ne=1000&N=1830&cname=Firearm-Accessories, generated Oct. 18, 2011.
Gander Mountain®, "Firearms > Firearm Accessories > Shooting Rest," obtained from http://search.gandermountain.com/?Ne=1000&N=1830&No=12&cname=Firearm-Accessories, generated Oct. 18, 2011.
Explore Products, "Gun Rests—Shooting Rests," obtained from http://www.exploreproducts.com/gunrests-shootingrests.htm, generated Oct. 18, 2011.
Midway USA, "Lead Sled Rifle Shooting Rest," obtained from http://www.midwayusa.com/Product/152664/caldwell-lead-sled-rifle-shooting-rest, generated Oct. 18, 2011.
MTM Case-Gard, "Predator Shooting Rest by MTM—PSR-30," obtained from http://www.mtmcase-gard.com/products/shooting/shooting-rests-psr.html, generated Oct. 18, 2011.
EWCalls, "Tri-X Stands Shooting Systems," obtained from http://www.ewcalls.com/products-page/gun-rests, generated Oct. 18, 2011.
Cabela's, "Cabela's Ultimate Field Rest," obtained from www.cabelas.com. generated Nov. 9, 2011.
Cabela's, "Stoney Point Tripod Rear Support," obtained from www.cabelas.com. generated Nov. 9, 2011.

* cited by examiner

VERSATILE SHOOTING REST

CROSS-REFERENCE TO RELATED APPLICATIONS

This is a non-provisional of U.S. Prov. Appl. No. 61/414,996, filed 18 Nov. 2010, which is incorporated herein by reference and to which priority is claimed.

BACKGROUND OF THE DISCLOSURE

Various types of weapons may be used for hunting. For example, firearms, such as handguns and rifles, can be used. In addition, hunters may use crossbows or other weapons. When hunting, hunters can support their weapons on shooting rests mounted on a tripod or other stand. Although existing shooting rests may be effective, hunters are always searching for more versatile equipment to meet their hunting needs. Moreover, hunters want to use equipment that can accommodate the diversity of weapons they may use.

The subject matter of the present disclosure is directed to overcoming, or at least reducing the effects of, one or more of the problems set forth above.

SUMMARY OF THE DISCLOSURE

A versatile shooting rest has a base with an adjustable riser on the nose thereof. A clamp mechanism holds the riser in place on the base so that a rest and optional insert on the top of the riser can be situated at desired heights from the top surface of the base. The insert can be used to accommodate different sized barrels or forearms of various firearms. The base affixes to a tripod or other stand and preferably uses a retention ball stem that allows for rotation on and quick connection to the base. A grip handle on the base can allow a user to rotate the base while mounted on the tripod conveniently while the weapon is mounted on the shooting rest. A rest and optional insert can attach to the top of the riser so the rest and insert can accommodate various types of weapons. The rest may not be removable from the riser, but different riser and rest combinations can be interchanged with the shooting rest to accommodate different weapons and styles. In addition, the rest may be removable from the riser so that different rests can be used. Overall, various risers, different types of rests, and optional inserts can be used with the base to accommodate various weapons.

The tail end of the base preferably slopes downward to accommodate features of longer weapons, such as rifles or the like, and/or to accommodate the user's arm. The versatile shooting rest can be adjusted to accommodate a number of weapons used for hunting, including handguns, pistols, revolvers, long rifles, AR style rifles, and crossbows.

The foregoing summary is not intended to summarize each potential embodiment or every aspect of the present disclosure.

DETAILED DESCRIPTION OF THE DISCLOSURE

Figure 1A:
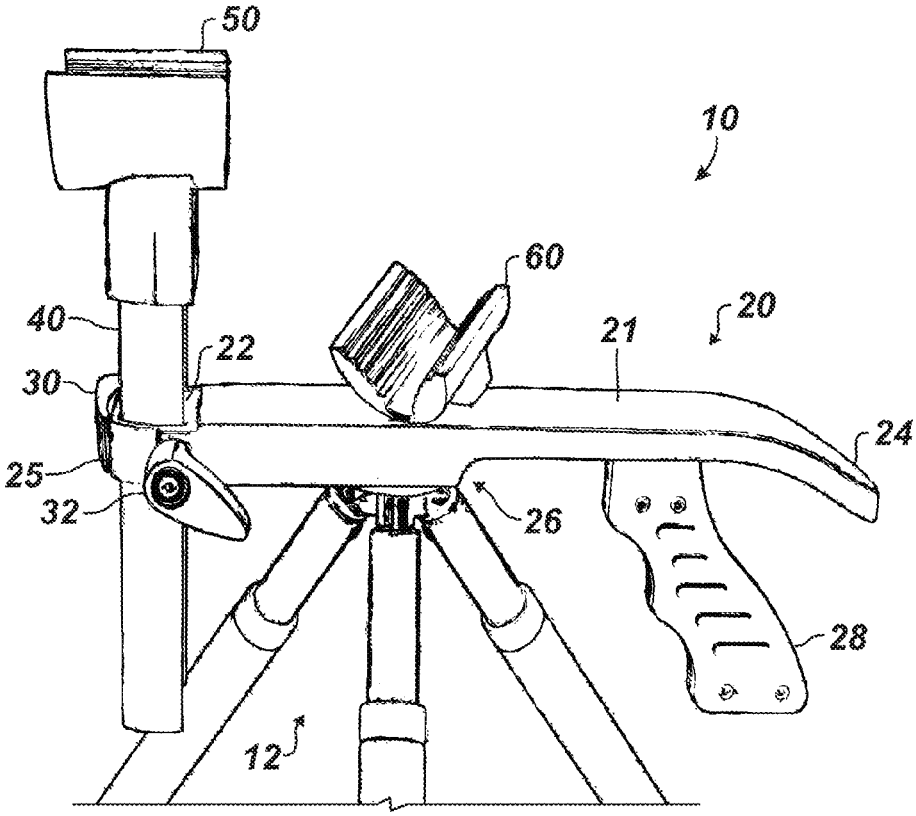
FIGS. 1A-1 D show various views of a versatile shooting rest according to the present disclosure.
Figure 1B:
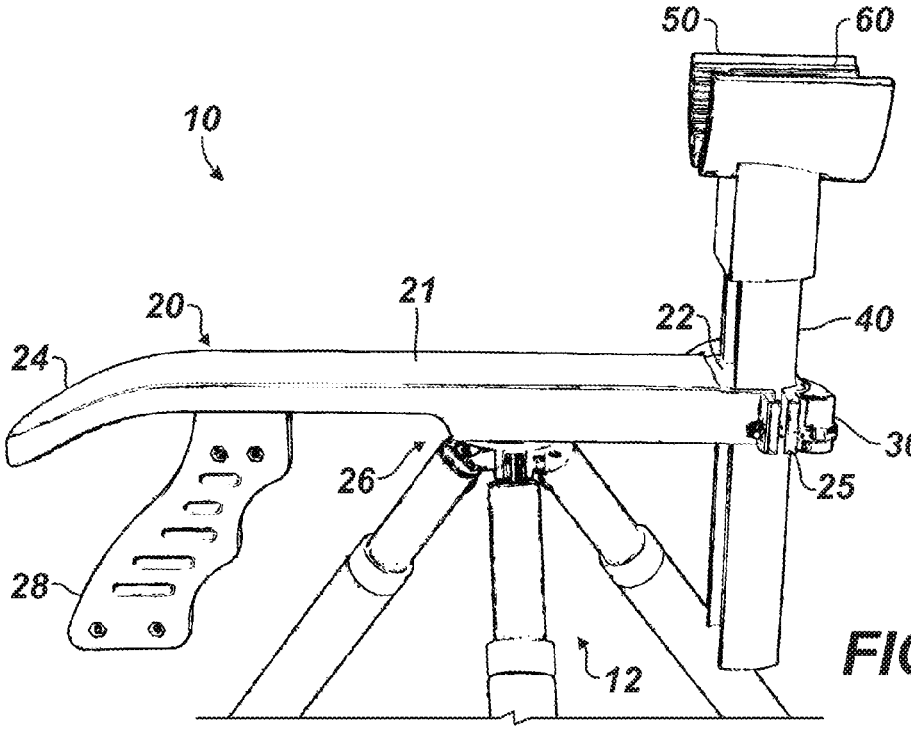
Figure 1C:
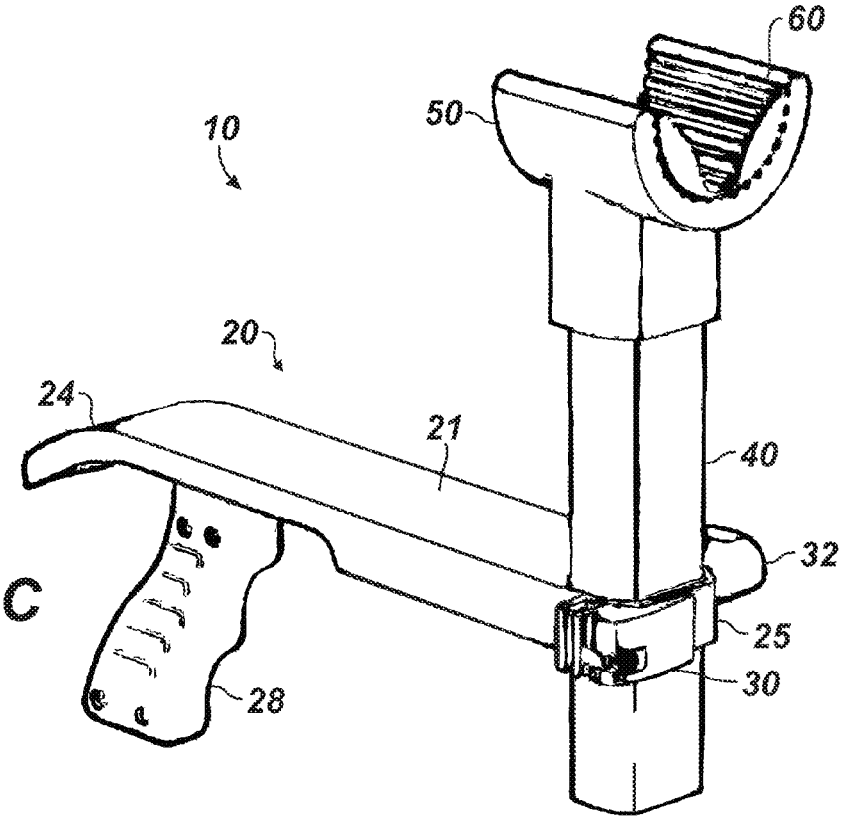
Figure 1D:
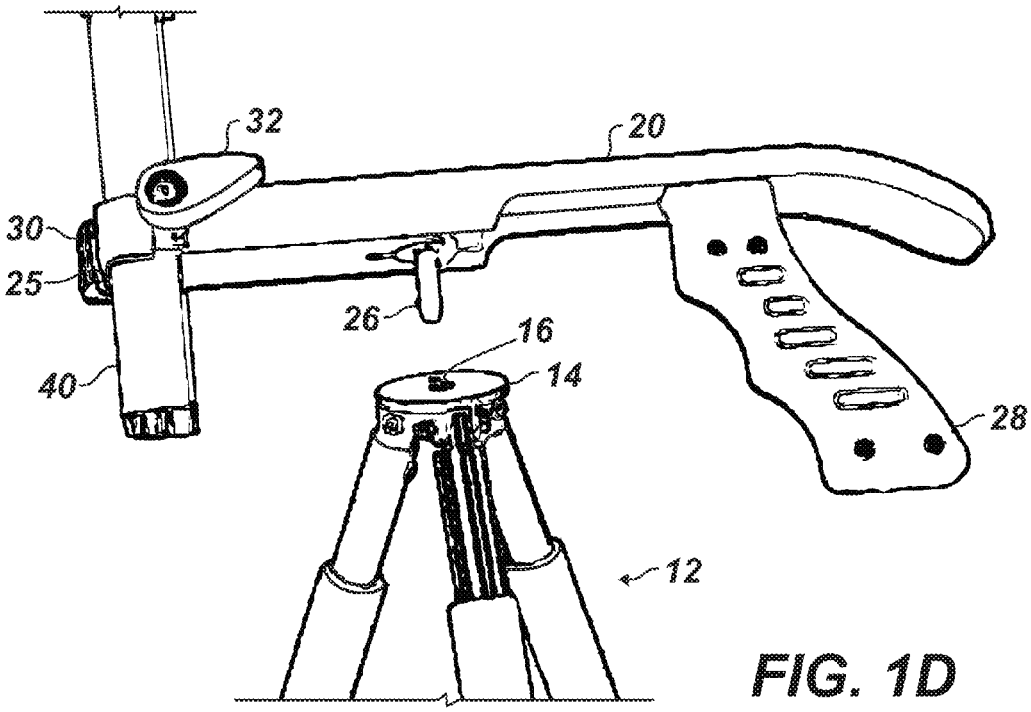
Figure 2C:
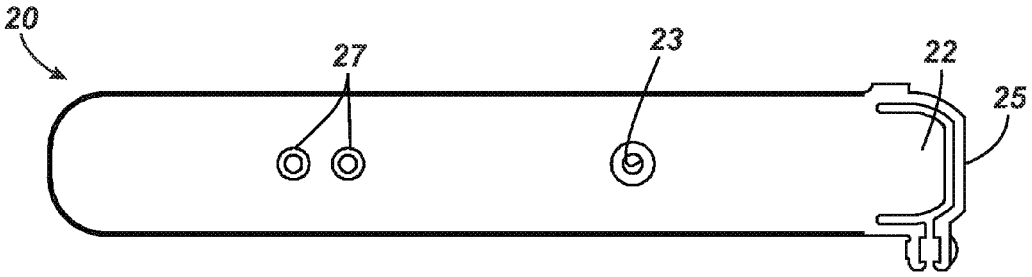
FIGS. 2A-2D show various views of a base for the versatile shooting rest of FIGS. 1A-1D.
Figure 2A:
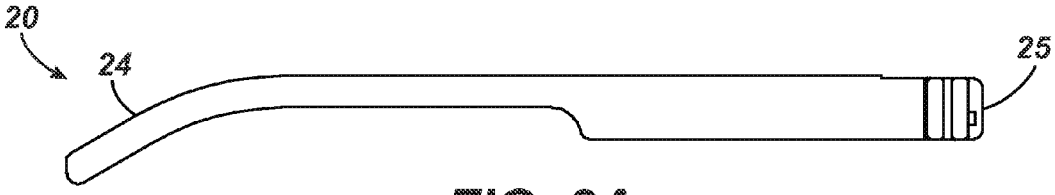
Figure 2B:
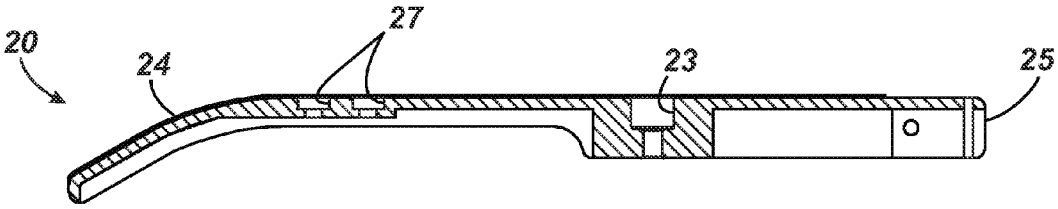
Figure 2D:
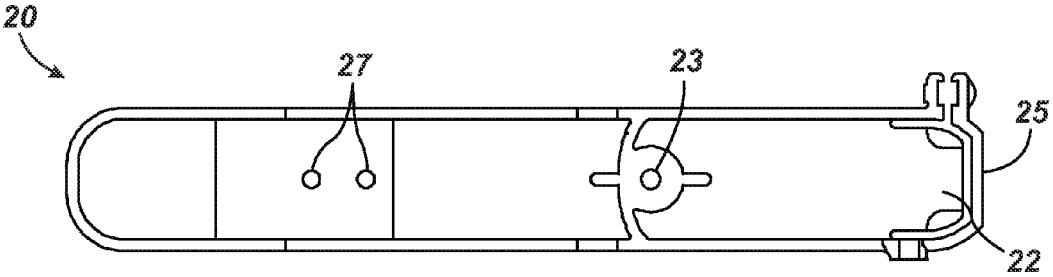

FIGS. 1A-1D show various a versatile shooting rest 10 according to the present disclosure in a left side view, a right side view, and a front perspective view. FIG. 1D is a bottom angle perspective view of the rest 10. The versatile shooting rest 10 is a specialized shooting rest for use with hunting weapons, such as handguns, rifles, crossbows, and the like.

The shooting rest 10 includes a base 20, a clamp mechanism 25, a lever lock 30, a riser 40, a rest 50, and one or more inserts 60. The base 20 has an upper surface 21 on which portions of a handgun, rifle, crossbow, or the like can rest. A tail end 24 of the base 20 slopes downward to accommodate a user's arm and/or features typically found on larger types of rifles or crossbows. The nose 22 of the base 20 has a clamp mechanism 25 with a lever lock 30 and a locking knob 32. A riser 40 fits inside the clamp mechanism 25 and can be adjusted up or down on the nose 22 of the base 20.

As shown, the riser 40 preferably uses a half-cylindrical bar with a channel 42, and the riser 40 can be pressed against the nose 22 of the base 20 by the clamp mechanism 25. The lever lock 30 and locking knob 32 can then be used to secure the clamp mechanism 25 tightly against the riser 40.

Although shown with the clamp mechanism 25, the lever lock 30, and the locking knob 32, other mechanisms can be used to hold the riser 40 on the nose 22 of the base 20. For example, a lock screw in the nose 22 of the base 20 can engage the side of the riser 40 disposed through an opening or slot in the base's nose 22. This and other suitable arrangements available in the art can be used.

As noted above, the shooting rest 10 has two locking devices—the front lever lock 30 and the side lock or locking knob 32. Features of these locking devices are shown throughout FIGS. 1A-1D. The knob 32 can have any appropriate style, such as round knob or lever. The front lever lock 30 pulls the sides of the clamp mechanism 25 together when the lock 30 is closed flat against the nose 22 of the base 20. The inside edge of the clamp mechanism 25 can be part of or integrated into the mold for the entire base 20. The edges of the clamp mechanism 25 can have teeth, grooves, or other similar features to help engage the riser 40 when clamped thereto.

The lever lock 30 binds the clamp mechanism 25 against the riser 40 to keep it from traveling up and down. The side locking knob 32 screws through the side of the base 20 via a threaded hole in the base 20. In this way, the end of the knob 32 contacts the riser 40 when the knob 32 is tightened so that the locking knob 32 also keeps the riser 40 from moving up or down. In short, the front mounted lever lock 30 binds the "C" shaped clamp mechanism 25 against the riser 40, and the locking knob 32 binds the riser 40 from an opposing direction. Together, these features keep the riser 40 from moving up or down when locked.

The top of the riser 40 has the rest 50 disposed thereon for supporting portions of a handgun, rifle, crossbow, or the like. As shown in FIGS. 1A-1B, the rest 50 can affix to the top of the riser 40. However, the insert 60 can removably fit inside the rest 50 so the size of the rest area can be adjusted to fit the shooting instrument being used. Thus, the rest 50 defines a first forked width that is greater than a second forked width of the insert 60. See FIGS. 4B-4C below.

Although one rest 50, insert 60, and riser 40 are shown, different shaped or sized rests 50, inserts 60, and risers 40 can be used and can be configured for particular barrels or forearms on weapons. For example, the rest 50 may not be removable from the riser 40, but different riser and rest combinations can be interchanged with the base 20 of shooting rest 10 to accommodate different weapons and styles. In addition, the rest 50 may be removable from the riser 40 so that different rests 50 can be used. Moreover, different shaped or sized inserts 60 can be used with the rest 50 and can also be configured for particular barrels or forearms on weapons. Overall, the various risers 40, different types of rests 50, and optional inserts 60 can be used with the base 20 to accommodate various weapons.

As shown throughout FIGS. 1A-1C, the base 20 affixes to a tripod or stand 12, which can have one or more legs. As best shown in FIG. 1D, the underside of the base 20 has a retention ball stem 26 that inserts in a slot 16 of the stand's mount 14. The retention balls on the stem 26 hold the base 20 to the mount 14 and preferably allow for rotation. Other mechanisms for attaching the base 20 to the stand 12 can be used.

The proximal end of the stem 26 in this and other embodiments of the shooting rest 10 can affix to the base 20 in a number of ways. For example, the stem 26 can thread into a hole in the base or into an embedded nut in the base. Alternatively, the stem 26 can have serrated grooves and can pressure fit into a hole in the bottom of the base 20. The connection can then be topped off with a counter sunk lock nut (not shown) for added strength. This nut and counter sunk hole can be covered a rubber matting glued to the base 20.

Figure 7A:
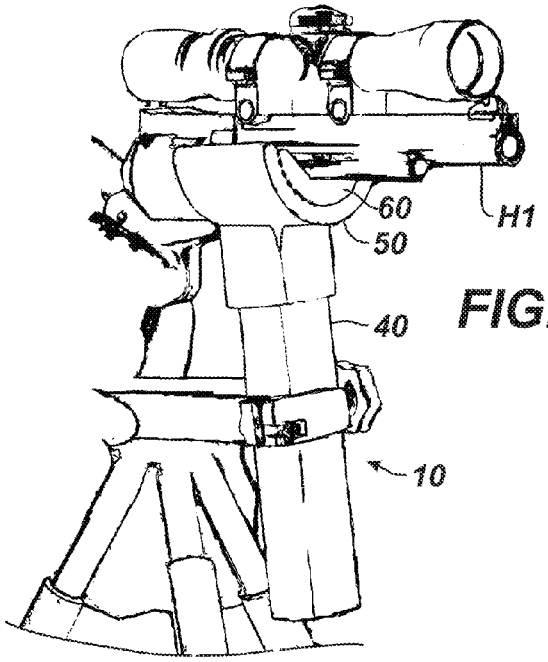
FIG. 7A shows one type of handgun used with the disclosed shooting rest.
Figure 7C:
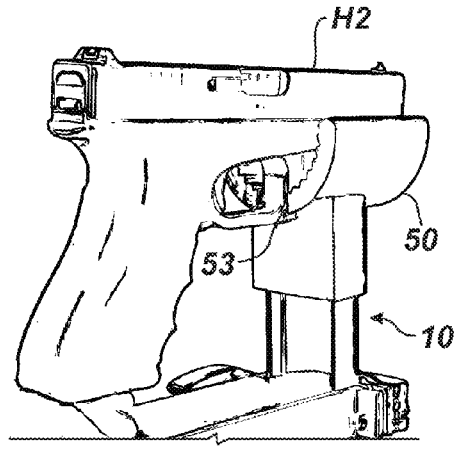
FIGS. 7B-7C shows another type of handgun used with the disclosed shooting rest.
Figure 7B:
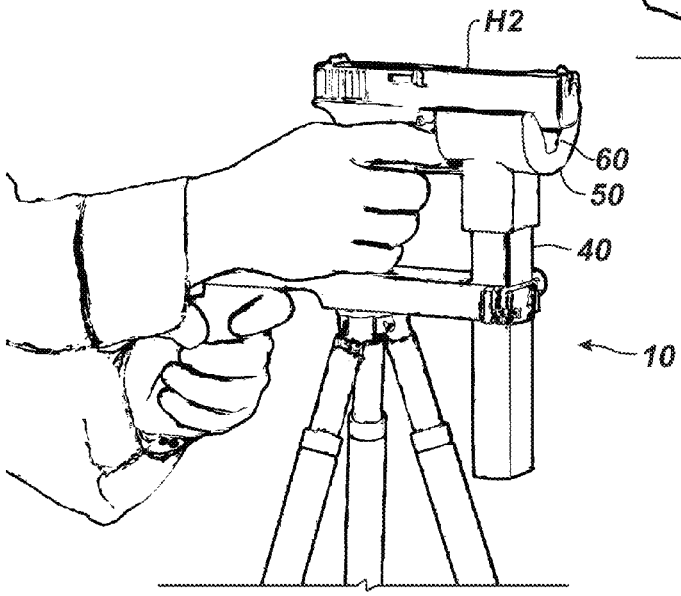

The underside of the base 20 can also include a grip handle 28, although this may not be strictly necessary. The grip handle 28 can allow a user to rotate and adjust the shooting rest 10 while disposed on the shooting stand 12. Additionally, the user can use the grip handle 28 for more stability when in a shooting position as shown in FIG. 7B, for example.

The rest's base 20 supports the butt, grip, handle, or other rear portion of the weapon used on the rest 10. To that end, discussion now turns to the base 20. Details of the base 20 are shown in FIGS. 2A-2D, which show side, cross-sectional, top, and bottom views of the base 20. Overall, the base 20 can be about 12-½ inches long from nose 22 to tail 24 and can be about 2 inches wide. The base 20 can be composed of any suitable material, such as metal, plastic or the like. For example, the body of the base 20 can be composed of acrylonitrile butadiene styrene (ABS) thermoplastic or another strong synthetic material.

The front end 22 of the base 20 has the clamp mechanism 25. Towards the back end, the base 20 can have countersunk holes 23 for fasteners to attach the handle grip 28. In addition, the base 20 can have a central countersunk hole 27 for the ball stem (26; FIG. 1D). The top surface 21 of the base 20 can include a top pad composed of a rubber material. The top pad on the surface 21 can fit on the base 20 with a tight pressure fit. This top pad on the surface 21 can be removable and replaceable to handle wear and tear or for use with various models of rifles and handguns. In general, the base 20 can be used with or without the pad on the surface 21.

Figure 3:
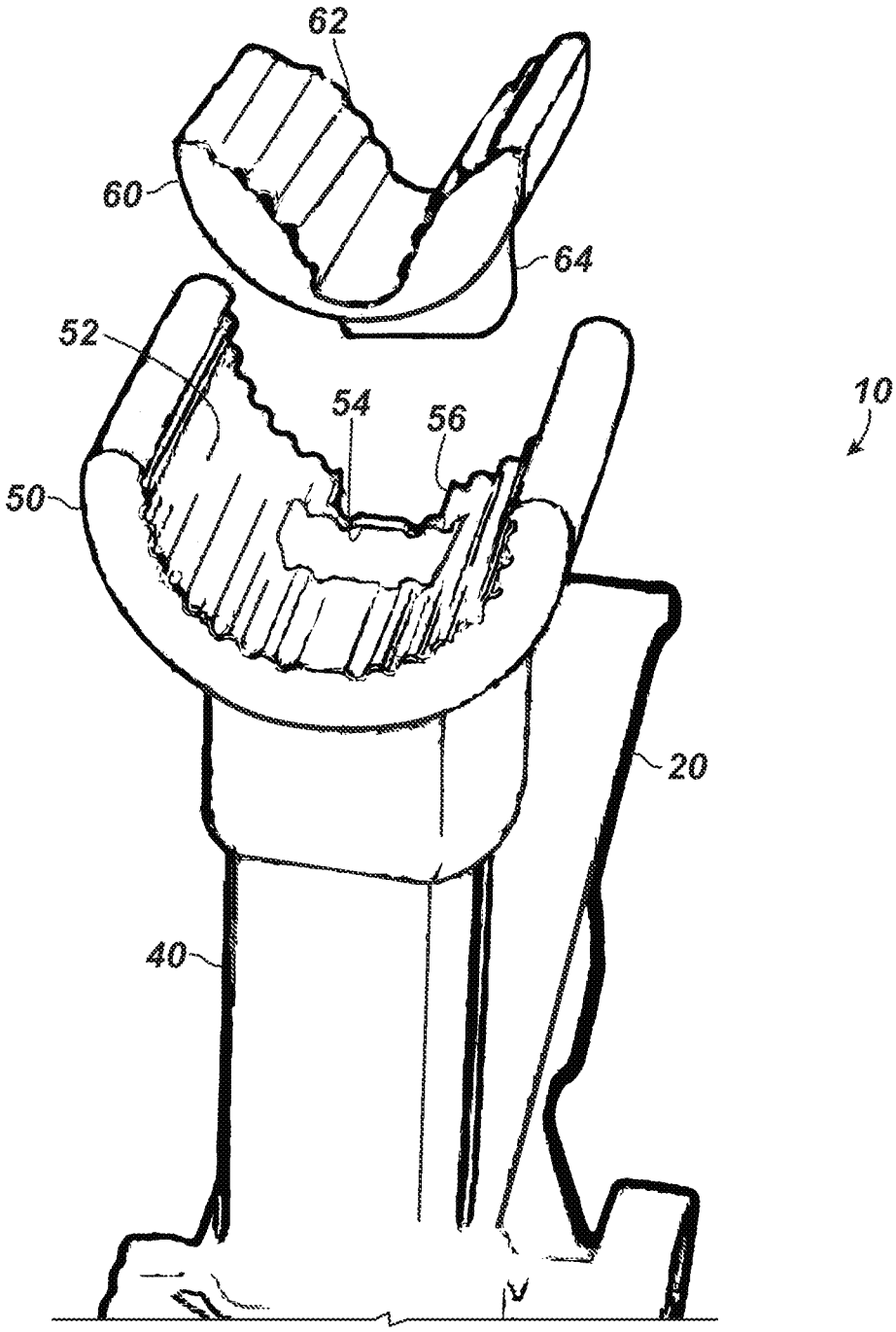
FIG. 3 shows a front perspective view of the riser, rest, and insert of the versatile shooting rest of FIGS. 1A-1D.
Figure 4B:
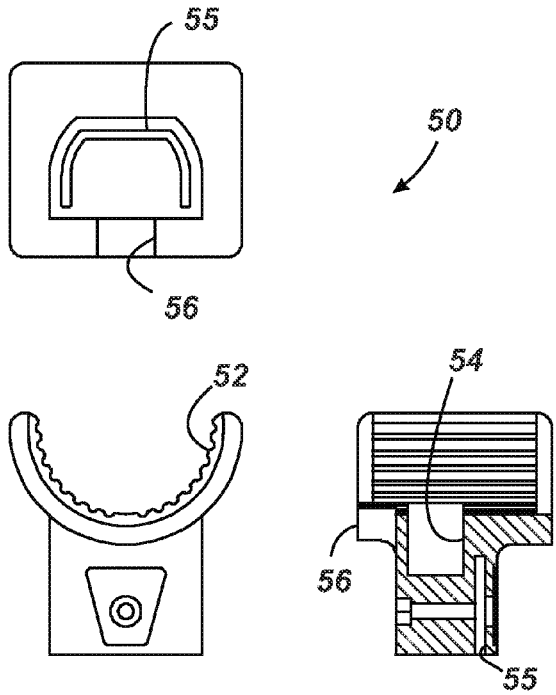
FIG. 4B shows various views of the rest for the versatile shooting rest of FIGS. 1A-1D.
Figure 4B:
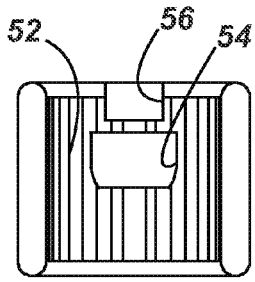
Figure 4A:
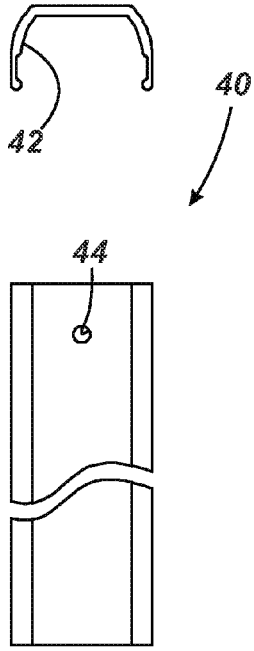
FIG. 4A shows isolated views of the riser for the versatile shooting rest of FIGS. 1A-1D.
Figure 4C:
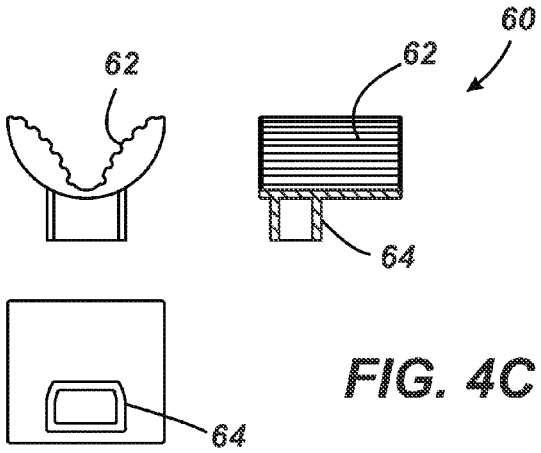
FIG. 4C shows various views of the insert for the versatile shooting rest of FIGS. 1A-1D.

Discussion now turns to the support for the front or forearm of the weapon supported on the shooting rest 10. To that end, a detailed view of of the rest 50 and the insert 60 on the top of the riser 40 is shown in FIG. 3, isolated views of the riser 40 are shown in FIG. 4A, isolated views of the rest 50 are shown in FIG. 4B, and isolated views of the insert 60 are shown in FIG. 4C. The riser 40 is preferably made from aluminum with a channel 42 formed therein. The riser 40 can extend to a height of about 6 inches or so above the base's top surface 21 when fully extended, and the channel 42 can be approx. 1.5 inches wide. The riser 40 provides up and down adjustment for supporting the front or forearm of the supported weapon and allows the shooting rest 10 to be used with various pistols, rifles, crossbows, and the like.

The rest 50 and insert 60 each define an arced rest area 52/62 that can include a number of grip features. The rest area 52 of the rest 50 defines a greater width than the insert 60. The rest 50 defines a slot 54 and has an end cutaway 56. The slot 54 accommodates the insert 60, while the end cutaway 56 accommodates a trigger guard, frame, or other portion of a pistol if present, as shown for example in FIG. 7C. On the rest 50, the rest's lower end has a U-shaped slot 55 that fits onto the top of the riser 40. A fastener (not shown) can fit through the rest's lower end and pass through a hole 44 of the riser 40 as shown in FIG. 4A to hold the rest 50 in place.

The insert 60 has a nodule 64 on its lower end for fitting into the rest's slot 54. The nodule 64 is preferably hollow so it can flex and squeeze fit into the rest's slot 54. When disposed in one orientation in the rest 60 as shown in FIG. 1B, for example, the insert 60 keeps the end cutaway 56 exposed. If desired, the insert 60 can be oriented in an opposite direction depending on the needs of the weapon being supported.

Figure 5A:
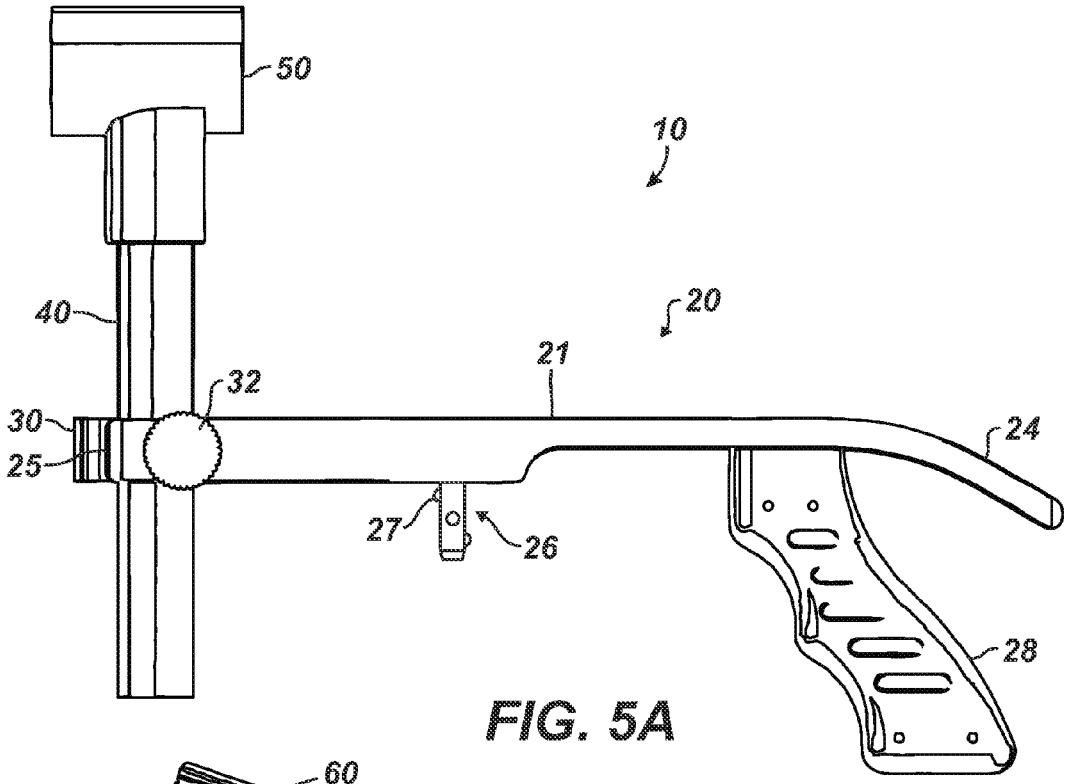
FIGS. 5A-5B show side and perspective views of another versatile shooting rest according to the present disclosure.
Figure 5B:
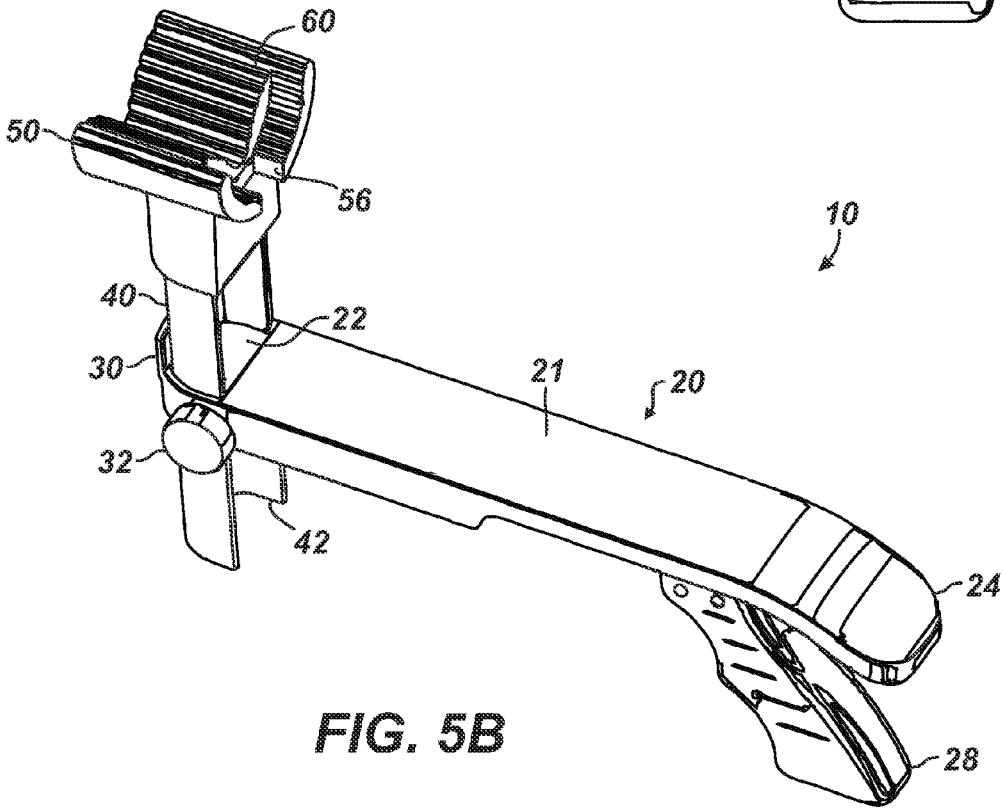

FIGS. 5A-5B show side and perspective views of another versatile shooting rest 10 according to the present disclosure. This shooting rest 10 is similar to that described previously so that like reference numbers are used for similar features. As shown in FIG. 5A, the retention ball stem 26 has a number of biased bearings 27 that allow the stem 26 to quick connect to the stand of a tripod and rotate once connected, as discussed previously. The locking knob 32 has a different shape on this rest 10.

Figure 6:
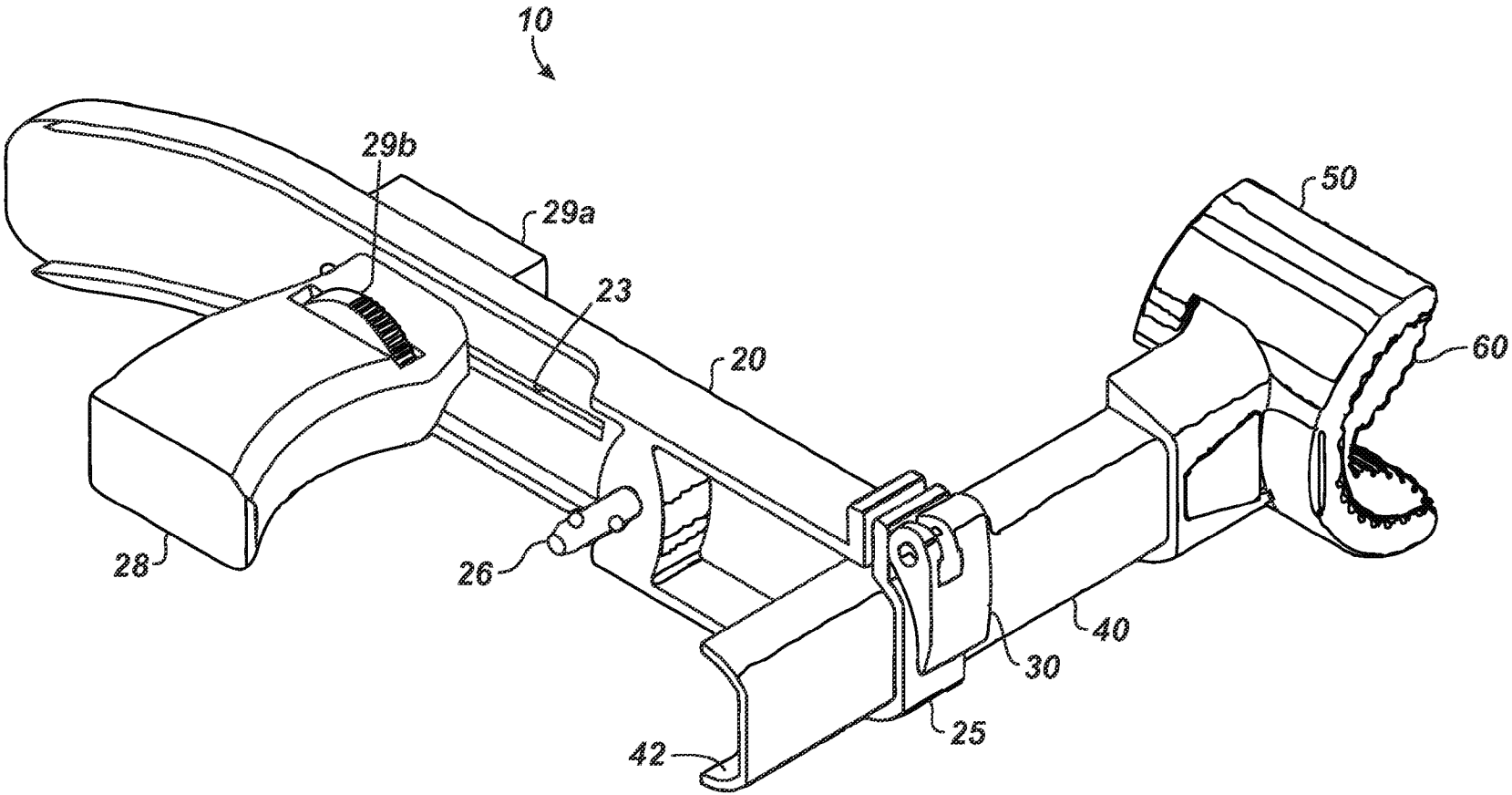
FIG. 6 shows a lower perspective view of yet another versatile shooting rest according to the present disclosure.

FIG. 6 shows a lower perspective view of yet another versatile shooting rest 10 according to the present disclosure. Again, this shooting rest 10 is similar to those described previously so that like reference numbers are used for similar features. The handle 28 on this shooting rest 10 is adjustable in a slot 23 defined in the base 20. The position of the handle 28 on the rest 10 can be moved closer or further from the tail end 24 in the base's slot 23, and lock components 29*a*-*b* for the handle 28 can be tightened to hold the handle 28 in place. For example, a lock block 29*a* is disposed on the top surface of the base 20 and connects to the handle 28 through the slot 23 with a bolt (not shown) or the like. A nut 29*b* can be adjusted on the handle 28 to tighten or loosen the handle 28 and block 29*a* on the base 20. Other mechanisms could be used for adjusting the position of the handle 28.

As noted previously, the versatile shooting rest 10 can be used with a variety of shooting instruments, including, but not limited to handguns, rifles, crossbows, and other weapons. For example, FIG. 7A shows one type of handgun H1 used with the disclosed shooting rest 10. This handgun H1 is a revolver and represents a traditional type of hunting handgun mounted on the shooting rest 10. FIGS. 7B-7C shows another type of handgun H2 used with the disclosed shooting rest 10. This handgun H2 is a semi-auto 1911 style pistol. In general, the versatile shooting rest 10 can accommodate handguns including, revolvers, bolt-action pistols, single shot pistols, and small, medium, or large frame pistols. For these handguns, both inner and outer rests 50/60 may be used on the top of the riser 40, and the grip of the handgun H1 can rest on the top surface 21 of the base 20. As shown in FIG. 7C, the cutaway 56 on the rest 50 can accommodate the trigger guard on the handguns if necessary.

Figure 8A:
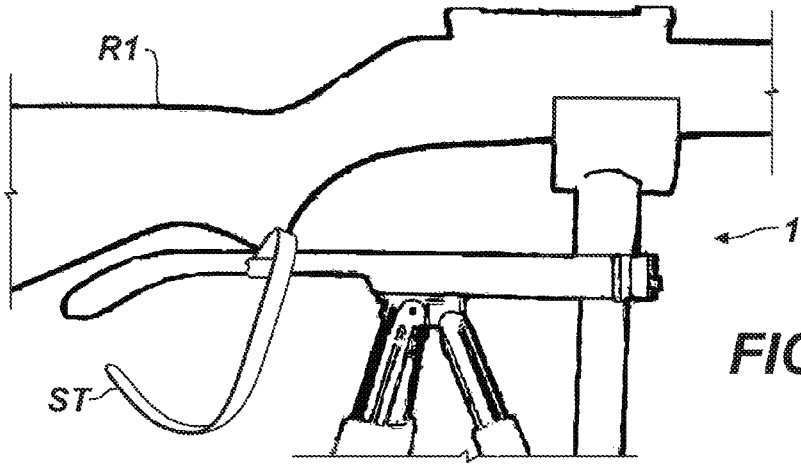
FIG. 8A shows one type of rifle used with the disclosed shooting rest.
Figure 8B:
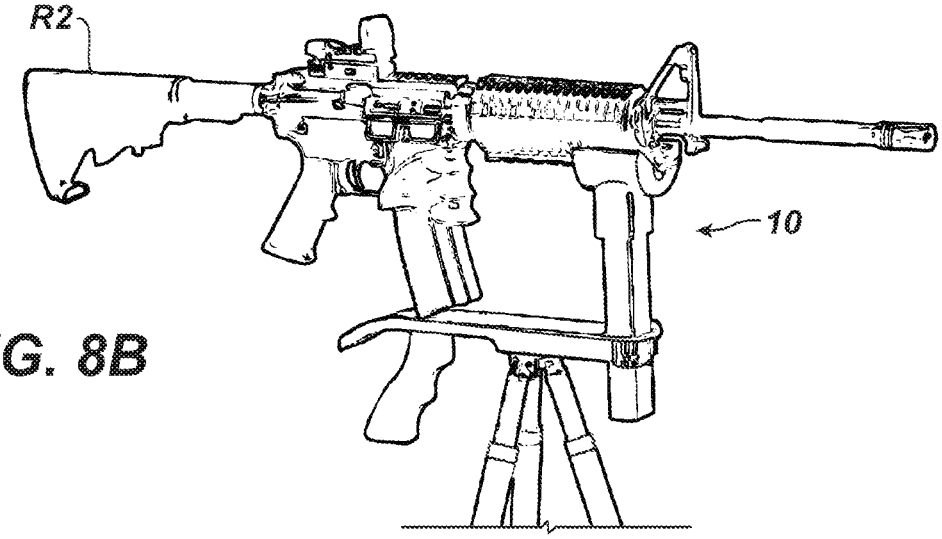
FIG. 8B shows another type of rifle used with the disclosed shooting rest.
Figure 8C:
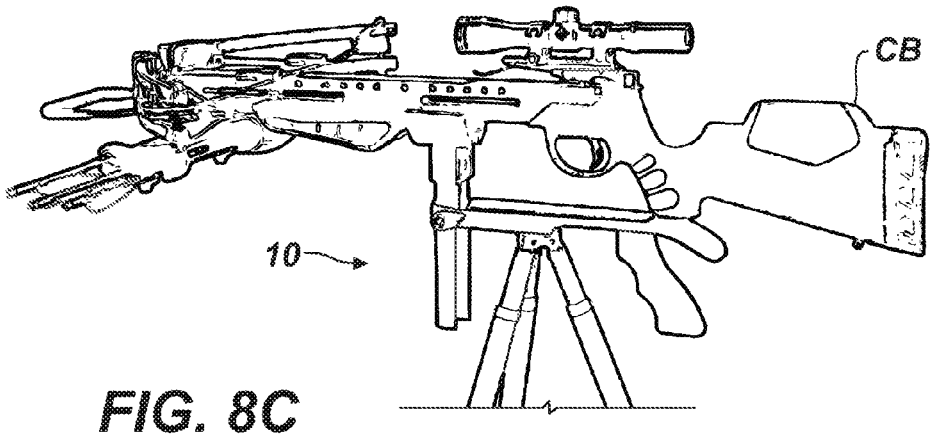
FIG. 8C shows a crossbow used with the disclosed shooting rest.

FIG. 8A shows one type of rifle R1 used with the disclosed shooting rest 10, while FIG. 8B shows another type of rifle R2 used with the disclosed shooting rest 10. The first rifle R1 is a conventional long rifle, such as a bolt action, lever action, single shot, falling block and muzzleloader rifle or primitive long stocked firearm. The second rifle R2 is an AR or M4 style rifle. Similar to the rifles, FIG. 8C shows a crossbow CB used with the disclosed shooting rest 10.

In any of these cases, only the outer rest 50 may be needed on the top of the riser 40 to accommodate these larger weapons. Adjustment of the riser's height helps fit the style of rifle R1-R2 or crossbow CB so that the front portions can be supported on the rest 50 while rear portions can rest on the base 20. If even wider rests are needed, the outer rest 50 can be removable from the riser 40 so that a larger, wider rest can be affixed to the top of the riser 40. Alternatively, another riser 40 with a different rest 50 can be inserted in the clamp mechanism 25 to accommodate larger or smaller weapons. Such an ancillary riser 40 may have a larger or shorter length and a wider or narrower stand to suit the particular weapon.

Although not shown in all of the Figures, the base 20 can include one or more straps ST as in FIG. 8A attached thereto that wrap around portions of the weapons when mounted on the shooting rest 10. When used, these straps ST can hold the weapon on the rest 10. In general, any suitable strap, tie down, or the like can be used.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A versatile shooting rest for supporting a weapon on a stand, the rest comprising:

a base having a top supporting a first portion of the weapon and having a bottom attaching to the stand;

a riser disposed on the base and having a distal end adjustable relative to the top of the base;

a lock disposed on the base and locking the riser in place thereon; and at least one rest disposed on the distal end of the riser and supporting a second portion of the weapon, the at least one rest comprising:

a first rest disposed on the distal end of the riser and defining a slot therein, and a second rest having a tab and interchangeably inserting into the slot in the first rest.

2. The rest of claim 1, wherein the base comprises a tail end sloping away from a plane defined by the top.

3. The rest of claim 1, wherein the first rest defines a first forked width; and wherein the second rest defines a second forked width being less than the first forked width.

4. The rest of claim 1, wherein the at least one rest defines a cutaway in an edge accommodating a third portion of the weapon.

5. The rest of claim 1, wherein the lock comprises a clamp disposed on a nose end of the base and clamping the riser against the nose end.

6. The rest of claim 1, wherein the lock comprises a bolt threaded in the base and engaging the riser.

7. The rest of claim 1, wherein the riser comprises a rod defining a longitudinal channel fitting against a nose end of the base.

8. The rest of claim 1, wherein the bottom of the base comprises a stem removably and rotatably attaching to the stand.

9. The rest of claim 1, further comprising one or more additional rests adapted to be interchangeably disposed on the distal end of the riser.

10. The rest of claim 1, further comprising one or more additional risers adapted to be interchangeably disposed on the base.

11. The rest of claim 1, wherein the base comprises a handle depending from the bottom thereof.

12. The rest of claim 11, wherein a position of the handle on the base is adjustable relative to a nose end of the base.

13. A shooting support for a weapon, the support comprising:

a stand having a mount, the mount defining a slot;

a base having a top supporting a first portion of the weapon and having a bottom attaching to the mount, the bottom having a stem extending therefrom and removably and rotatably positioning in the slot, the stem comprising one or more biased bearings disposed thereon and engaging in the slot;

a riser disposed on the base and having a distal end adjustable relative to the top of the base;

a lock disposed on the base and locking the riser in place thereon; and at least one rest disposed on the distal end of the riser and supporting a second portion of the weapon.

14. The support of claim 13, wherein the stand comprises at least one leg supporting the mount above ground.

15. A versatile shooting apparatus for supporting a weapon, the apparatus comprising:

a mount;

at least one leg supporting the mount;

a base having a bottom, a top, and a nose end, the bottom having a stem rotatably attaching to the mount, the top supporting a first portion of the weapon, the nose end having a clamp;

a riser disposed on the nose end of the base and engaged by the clamp, the riser having a distal end adjustable relative to the top of the base; and a first rest disposed on the distal end of the riser and supporting a second portion of the weapon, the first rest defining a first forked width; and a second rest defining a second forked width less than the first forked width, the second rest interchangeably inserting in the first forked width of the first rest.

16. The apparatus of claim 15, wherein the first rest defines a slot therein, and wherein the second rest has a tab interchangeably inserting into the slot in the first rest.

17. The apparatus of claim 15, wherein the first rest defines a cutaway in an edge accommodating a third portion of the weapon.

18. The apparatus of claim 15, wherein the clamp comprises a bolt threaded in the base and engaging the riser.

19. The apparatus of claim 15, further comprising at least one of:

one or more additional rests adapted to be interchangeably disposed on the distal end of the riser; and one or more additional risers adapted to be interchangeably disposed on the base.

20. The support of claim 13, wherein the at least one rest comprises:

a first rest disposed on the distal end of the riser and defining a slot therein, and a second rest having a tab and interchangeably inserting into the slot in the first rest.

21. The support of claim 13, wherein the at least one rest comprises:

a first rest disposed on the distal end of the riser and defining a first forked width; and a second rest defining a second forked width less than the first forked width, the second rest interchangeably inserting in the first forked width of the first rest.

22. The support of claim 13, wherein the at least one rest defines a cutaway in an edge accommodating a third portion of the weapon.

23. The support of claim 13, wherein the lock comprises at least one of:

a clamp disposed on a nose end of the base and clamping the riser against the nose end; and a bolt threaded in the base and engaging the riser.

24. The support of claim 13, further comprising at least one of:

one or more additional rests adapted to be interchangeably disposed on the distal end of the riser; and one or more additional risers adapted to be interchangeably disposed on the base.

25. A versatile shooting rest for supporting a weapon on a stand having a slot, the rest comprising:

a base having a top supporting a first portion of the weapon and having a bottom attaching to the stand, the bottom having a stem extending therefrom and removably and rotatably positioning in the slot, the stem comprising one or more biased bearings disposed thereon and engaging in the slot;

a riser disposed on the base and having a distal end adjustable relative to the top of the base;

a lock disposed on the base and locking the riser in place thereon; and at least one rest disposed on the distal end of the riser and supporting a second portion of the weapon.

26. The rest of claim 25, wherein the at least one rest comprises:

a first rest disposed on the distal end of the riser and defining a slot therein, and a second rest having a tab and interchangeably inserting into the slot in the first rest.

27. The rest of claim 25, wherein the at least one rest comprises:

a first rest disposed on the distal end of the riser and defining a first forked width, and a second rest defining a second forked width less than the first forked width, the second rest interchangeably inserting in the first forked width of the first rest.

28. The rest of claim 25, wherein the at least one rest defines a cutaway in an edge accommodating a third portion of the weapon.

29. The rest of claim 25, wherein the lock comprises at least one of:

a clamp disposed on a nose end of the base and clamping the riser against the nose end; and a bolt threaded in the base and engaging the riser.

30. The rest of claim 25, further comprising at least one of:

one or more additional rests adapted to be interchangeably disposed on the distal end of the riser; and one or more additional risers adapted to be interchangeably disposed on the base.

31. A versatile shooting rest for supporting a weapon on a stand, the rest comprising:

a base having a top supporting a first portion of the weapon and having a bottom attaching to the stand;

a riser disposed on the base and having a distal end adjustable relative to the top of the base;

a lock disposed on the base and locking the riser in place thereon; and at least one rest disposed on the distal end of the riser and supporting a second portion of the weapon, the at least one rest comprising:

a first rest disposed on the distal end of the riser and supporting a second portion of the weapon, the first rest defining a first forked width, and a second rest defining a second forked width less than the first forked width, the second rest interchangeably inserting in the first forked width of the first rest.

32. The rest of claim 31, wherein the at least one rest defines a cutaway in an edge accommodating a third portion of the weapon.

33. The rest of claim 31, wherein the lock comprises at least one of:

a clamp disposed on a nose end of the base and clamping the riser against the nose end; and a bolt threaded in the base and engaging the riser.

34. The rest of claim 31, wherein the bottom of the base comprises a stem removably and rotatably attaching to the stand.

35. The rest of claim 31, further comprising at least one of:

one or more additional rests adapted to be interchangeably disposed on the distal end of the riser; and one or more additional risers adapted to be interchangeably disposed on the base.

* * * * *